US010358822B2

(12) United States Patent
Bruhnke et al.

(10) Patent No.: US 10,358,822 B2
(45) Date of Patent: Jul. 23, 2019

(54) INTEGRATED CROSS BAR WITH MOUNTING TAB FOR GRILLE

(71) Applicants: Lynne Bruhnke, Massapequa Park, NY (US); Daniel Roeper, Garden City, NY (US)

(72) Inventors: Lynne Bruhnke, Massapequa Park, NY (US); Daniel Roeper, Garden City, NY (US)

(73) Assignee: INV. HOLDINGS, INC., New Hyde Park, NY (US)

( * ) Notice: Subject to any disclaimer, the term of this patent is extended or adjusted under 35 U.S.C. 154(b) by 0 days.

(21) Appl. No.: 14/545,247

(22) Filed: Apr. 13, 2015

(65) Prior Publication Data

US 2016/0298331 A1 Oct. 13, 2016

(51) Int. Cl.

| | |
|---|---|
| ***E04C 2/40*** | (2006.01) |
| ***E06B 9/01*** | (2006.01) |
| ***F24F 13/08*** | (2006.01) |

(52) U.S. Cl.

CPC ..... *E04C 2/40* (2013.01); *E06B 9/01* (2013.01); *F24F 13/084* (2013.01)

(58) Field of Classification Search

CPC ..... E06B 9/01; B60R 19/52; B60R 2019/525; E04C 2/40; F24F 13/084

USPC ..... 296/193.1, 180.1

See application file for complete search history.

(56) References Cited

U.S. PATENT DOCUMENTS

| | | | | | |
|---|---|---|---|---|---|
| 1,996,047 | A * | 3/1935 | Green | B60R 19/52 | 52/473 |
| 2,033,376 | A * | 3/1936 | Hanson | B60R 19/52 | 52/662 |
| 2,668,729 | A * | 2/1954 | Watters | E06B 9/01 | 292/137 |
| 2,796,141 | A * | 6/1957 | Schreiner | B60R 19/52 | 165/119 |
| 3,713,613 | A * | 1/1973 | Searls | H04Q 1/06 | 248/228.1 |
| 4,358,910 | A * | 11/1982 | Keating | E06B 9/04 | 49/394 |
| 4,403,648 | A * | 9/1983 | Styok | F28F 9/002 | 165/149 |
| 5,082,083 | A | 1/1992 | Draffen | | |
| 5,623,791 | A * | 4/1997 | Schwarz | E06B 9/01 | 248/74.1 |
| 6,347,903 | B1 * | 2/2002 | Knighton | E04C 5/166 | 403/213 |
| 6,776,706 | B2 | 8/2004 | Kipka | | |
| 7,549,260 | B2 * | 6/2009 | Shepherd | B23P 15/12 | 403/364 |
| 2002/0022450 | A1 * | 2/2002 | Berger | F24F 13/02 | 454/290 |
| 2005/0023863 | A1 * | 2/2005 | Stull | B60R 19/52 | 296/193.1 |
| 2008/0224006 | A1 * | 9/2008 | Call | H04R 1/026 | 248/231.9 |
| 2008/0246289 | A1 * | 10/2008 | Skinner | B60R 19/52 | 293/115 |
| 2010/0326000 | A1 * | 12/2010 | Garcia | E04D 3/364 | 52/520 |

(Continued)

*Primary Examiner* — Joshua K Ihezie
(74) *Attorney, Agent, or Firm* — Weiss & Weiss Attorneys; Philip Weiss

(57) ABSTRACT

A cross bar and mounting tab being a single piece for mounting a linear bar grille.

8 Claims, 8 Drawing Sheets

(56) References Cited

U.S. PATENT DOCUMENTS

| | | | | |
|---|---|---|---|---|
| 2013/0130612 | A1* | 5/2013 | Penlesky ..... | F24F 7/013<br>454/237 |
| 2014/0251120 | A1 | 9/2014 | Schade | |

* cited by examiner

INTEGRATED CROSS BAR WITH MOUNTING TAB FOR GRILLE

FIELD OF THE INVENTION

The present invention relates to an integrated cross bar having a mounting tab or tabs for a linear bar grille.

BACKGROUND OF THE INVENTION

U.S. Pat. No. 5,082,083 relates to a wall mounted stereo speaker assembly wherein the woofer of the speaker is mounted in the assembly wall frame and the tweeter is both mounted in and self-contained within the assembly wall frame. Installation requires a circular opening be cut in the wall to enable the rear portion of the woofer to extend through the dry wall or sheetrock and two holes drilled in the wall to accommodate the support bolts to retain the wall mounted speaker assembly on the wall.

U.S. Pat. No. 5,623,791 relates to a protective grille assembly mountable over a window opening in a wall, that includes a grill panel having a plurality of parallel spaced vertical bars fixed to a plurality of parallel spaced horizontal bars. A plurality of fastening brackets mount the grille panel to the wall to cover the opening. Each bracket includes a loop section for slidably enclosing an end of a bar at the projecting side of the grille panel, and a fastening section for fastening the bracket to the wall after the loop section, while enclosing an end of a bar, has been slid along the respective bar to a location where the fastening section can be fastened to a mounting surface of the wall.

U.S. Pat. No. 6,776,706 relates to a modular fan system that includes a fan, a plenum member adapted to be mounted to the fan and adapted to be mounted to an enclosure, a gasket adapted to be mounted between the plenum member and the enclosure, a filter adapted to be mounted to the plenum member, and a grille adapted to be mounted to the plenum member.

U.S. Pat. No. 7,549,260 relates to an array of parallel cross bars, each cross bar has a crenelated edge with alternating recesses and projections. A first locking opening extends through the length of each cross bar, at least partly within the projections. A number of bearing bars each include second locking openings spaced along the length of the bearing bar. The bearing bars are assembled with the cross bars with the bearing bars nestled in the recesses in the cross bars. The first and second locking openings are in alignment. A locking member is received in the aligned locking openings to interlock the bearing bars and cross bars in a rigid, strong, durable and attractive grille structure.

U.S. patent publication 2008/0224006 relates to a flush-mounting system including a bracket with an opening that is coupled to a support extending substantially in a plane to allow the mounting bracket to move along the support. An inner bracket is disposed with the mounting bracket's opening and can be slid in and out of the opening to adjust accordingly. The flush mounting system also has a second support extending parallel to the first support and a mechanism coupling an opposite side of the bracket to the second support.

U.S. patent publication 2014/0251120 relates to a grille design that narrows the louver pitch and narrows the louver construction so as to maintain the air flow throughout the grille. An aerodynamic shape is applied to the leading edge of the louver thus lowering drag and reducing the pressure drop at the inlets.

A typical grille includes a number of main bars extending generally in a first direction, with cross-bars extending in a traverse direction. The bars are attached at an intersection to form a rigid structure. Previously in order to mount grilles in any application, available methods were through holes in the grille frame, through holes in the grille flange, and mounting tabs welded between the linear bars. All of these are time consuming and detract from the appearance of the grille.

SUMMARY OF THE INVENTION

The present invention relates to a device for mounting linear bar grilles to walls, ceilings, baseboards, floors, vents, ducts, HVAC systems, millwork, trenches, radiators, linear bar grille frames, convectors, and enclosures. The present invention relates to a mounting device that comprises an integrated cross bar with a mounting tab and/or tabs. The mounting tab is a pre-punched, cut or perforated, pre-cut tab. The mounting tab is bent at a right angle. The cross bar and mounting tab are one piece. The mounting tab has a through hole to accommodate a mechanical fastener. The mechanical fastener attaches the grille to a duct, framed opening, wall, ceiling, base board, HVAC system, cabinet base, vent, radiator, floor, window sill, trench or enclosure. It is an object of the present invention for the mounting tab to be used to make the core (linear bar section) of the grille removable and re-attachable to the grille frame. It is an object of the present invention for the fastener to be placed through a metal lip of a duct in a wall or ceiling. It is an object of the present invention for the fastener to be placed through a metal lip at an edge of a radiator enclosure.

It is an object of the present invention for the fastener to be attached to a duct flange. It is an object of the present invention for the fastener to be attached to a convector cover. It is an object of the present invention for the fastener to be attached to a wooded frame. It is an object of the present invention for the fastener to be attached to a millwork. It is an object of the present invention for the fastener to be attached to a wood blocking. It is an object of the present invention for the fastener to be attached to a duct opening. It is an object of the present invention for the fastener to be attached to a flange of a vent opening. It is an object of the present invention for the fastener to be attached to a frame of a HVAC system opening. It is an object of the present invention for the fastener to be attached to a wall system. It is an object of the present invention for the fastener to be attached to the frame of a linear bar grille making the core portion removable and re-attachable.

It is an object of the present invention for the mounting tab or tabs to be placed anywhere along the length of the crossbar.

It is an object of the present invention for the linear bar grille to be any width, length or material.

It is an object of the present invention for the mounting tabs to be put anywhere on the linear bar grille and to use as many integrated cross bars and mounting tabs as required.

The prior art devices use a very time consuming and costly process of welding multiple pre-manufactured tabs (separate piece that must be made) between the long bars.

It is an object of the present invention to eliminate the need to make a separate mounting tab and a separate cross bar.

It is an object of the present invention to eliminate the welding process needed to attach the mounting tab to the grille. During the welding process, there is a high likelihood that the weld will fill the mounting hole and need to be cleared with a secondary drilling process.

It is an object of the present invention to eliminate the need to grind down the excessive weld bead on the back of the tab.

It is an object of the present invention to eliminate manually measuring, locating and positioning the separate tab which then must be welded. Many times the tab shifts and must be re-welded.

It is an object of the present invention for the mounting tab to decrease errors and re-works.

It is an object of the present invention to eliminate the need to manually set the critical depth of a separate mounting tab.

It is an object of the present invention that the mounting tab be utilized to attach the linear bar core portion of the linear bar grille to a linear bar grille frame.

DETAILED DESCRIPTION OF THE INVENTION

Figure 1:
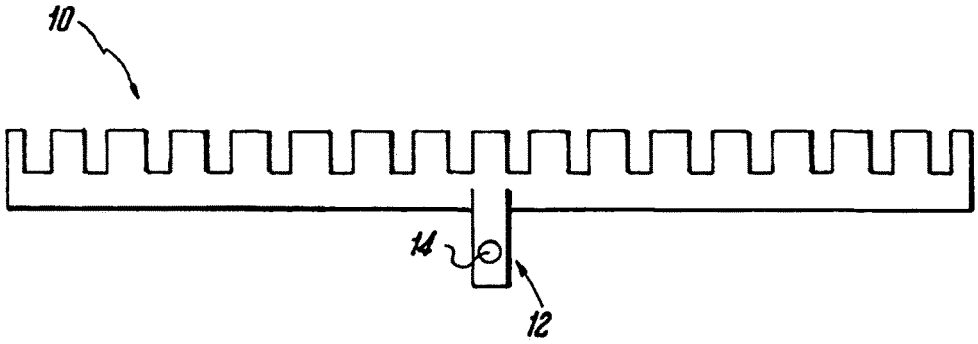
FIG. 1 is a side view of the device of the present invention prior to the mounting tab being bent into position.

FIG. 1 shows the cross bar 10 having a mounting tab 12 with a through hole 14, prior to the mounting tab 12 being bent into position.

Figure 2:
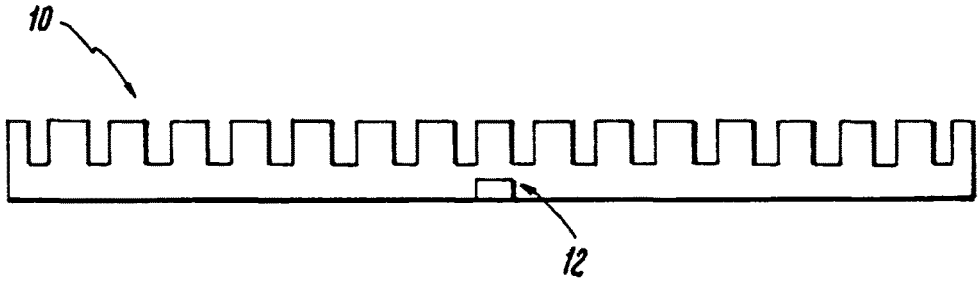
FIG. 2 is a side view of the device of the present invention after the mounting tab is bent into position.

FIG. 2 shows the cross bar 10 having the mounting tab 12, after the mounting tab is bent into position.

Figure 3:
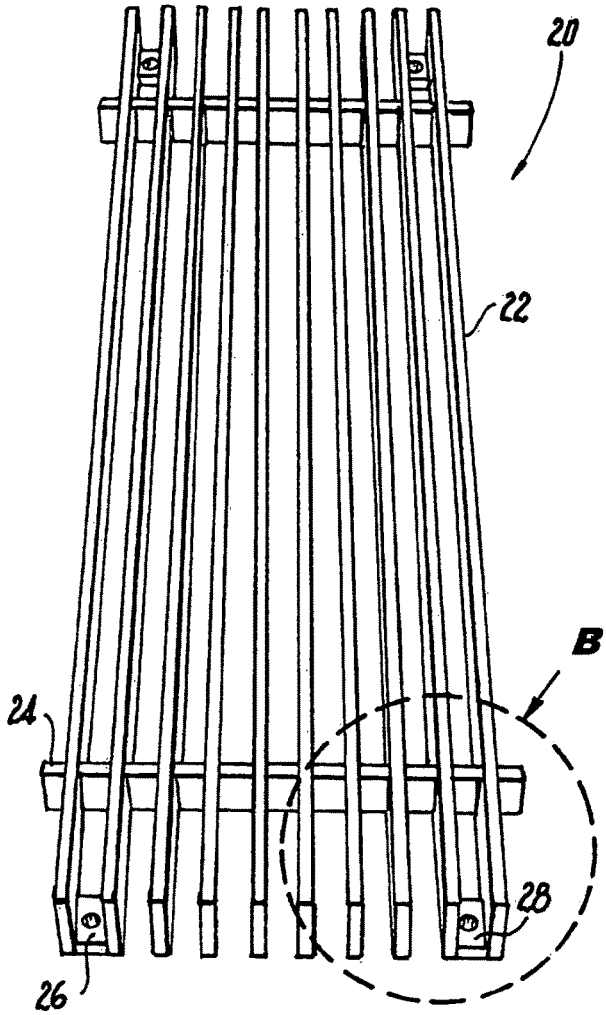
Fig. 3 (Prior Art)
FIG. 3 is a top view of a prior art device.

FIG. 3 shows a prior art linear bar grille 20 having linear bars 22, a cross bar 24, and mounting tabs 26 and 28. The mounting tabs 26 and 28 are welded between open spaces between linear bars 22.

Figure 4:
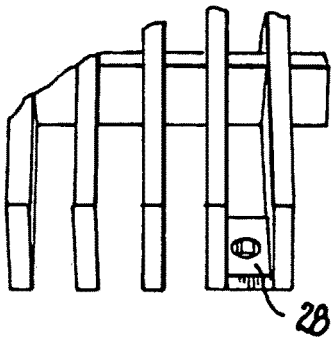
Fig. 4 (Prior Art)
FIG. 4 is a sectional view through section B found in FIG. 3 of the prior art device.

FIG. 4 shows a sectional view through section B of FIG. 3.

Figure 5:
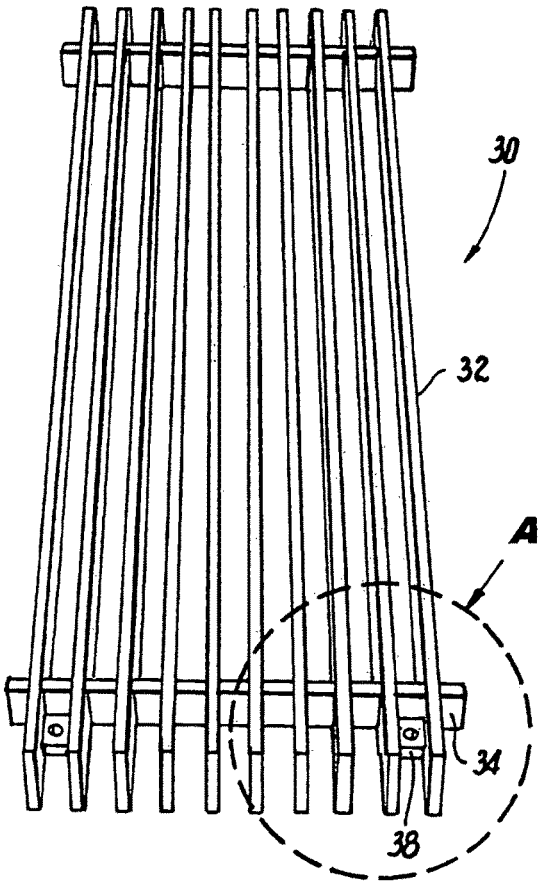
FIG. 5 is a top view of the device of the present invention.

FIG. 5 shows the linear bar grille 30 of the present invention having linear bars 32, a cross bar 34, and mounting tabs 36 and 38 that are part of the cross bar 34.

Figure 6:
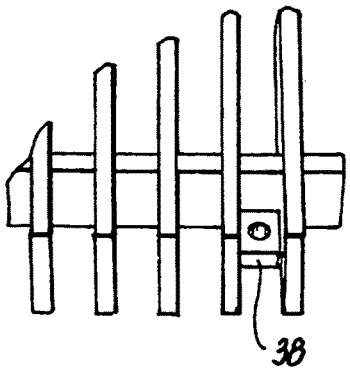
FIG. 6 is a sectional view through section A found in FIG. 5 of the device of the present invention.

FIG. 6 shows a sectional view through section A of FIG. 5.

Figure 7:
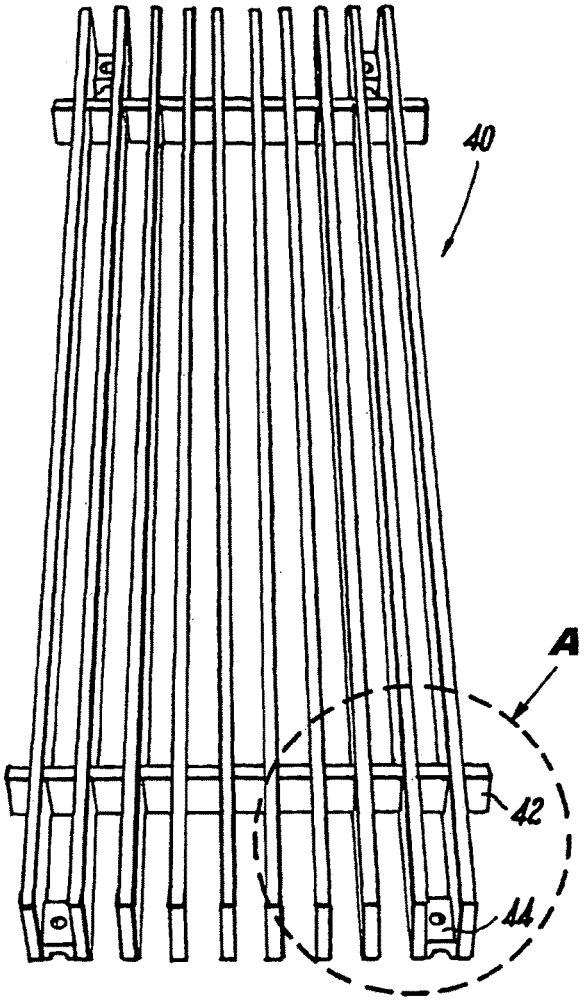
Fig. 7 (Prior Art)
FIG. 7 is top view of a prior art welded tab.

FIG. 7 shows a top view of a prior art linear bar grille 40 having a cross bar 42 and a prior art welded tab 44.

Figure 8:
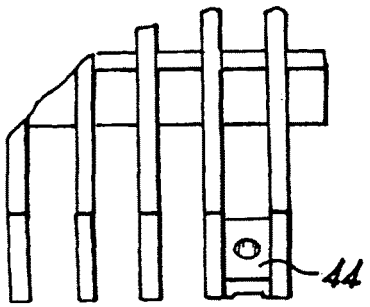
Fig. 8 (Prior Art)
FIG. 8 is detailed view of section A of FIG. 7.

FIG. 8 is a sectional view through section A of FIG. 7 showing the prior art welded tab 44.

Figure 9:
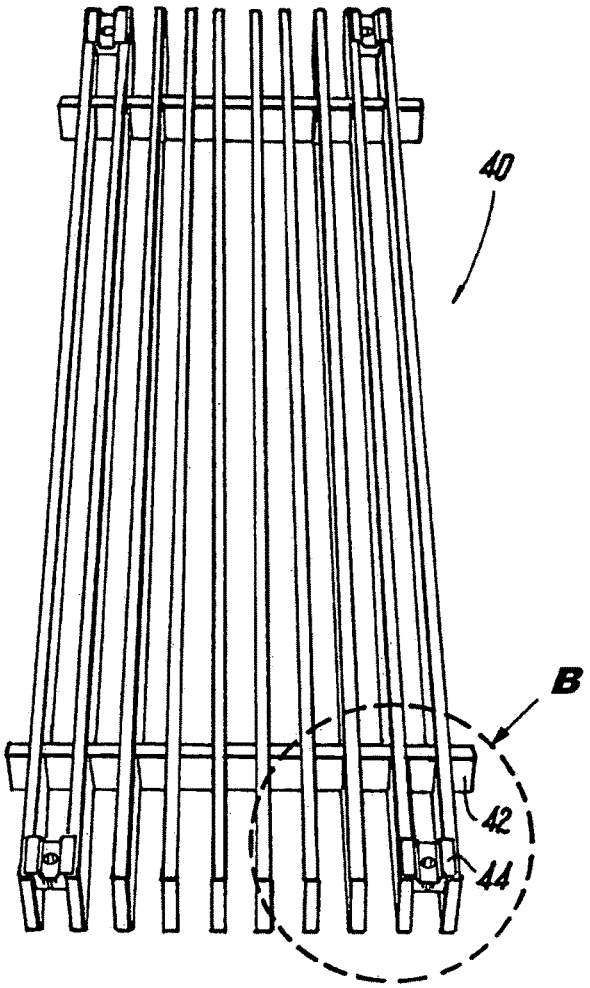
Fig. 9 (Prior Art)
FIG. 9 is a bottom view of a prior art welded tab.

FIG. 9 shows a bottom view of a prior art linear bar grille 40 having a cross bar 42 and a prior art welded tab 44.

Figure 10:
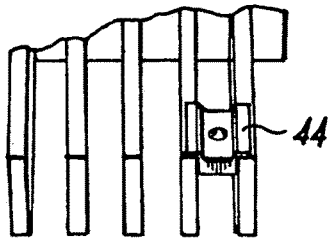
Fig. 10 (Prior Art)
FIG. 10 is detailed view of section B of FIG. 9.

FIG. 10 is a sectional view of section B of FIG. 9 showing the prior art welded tab 44.

Figure 11:
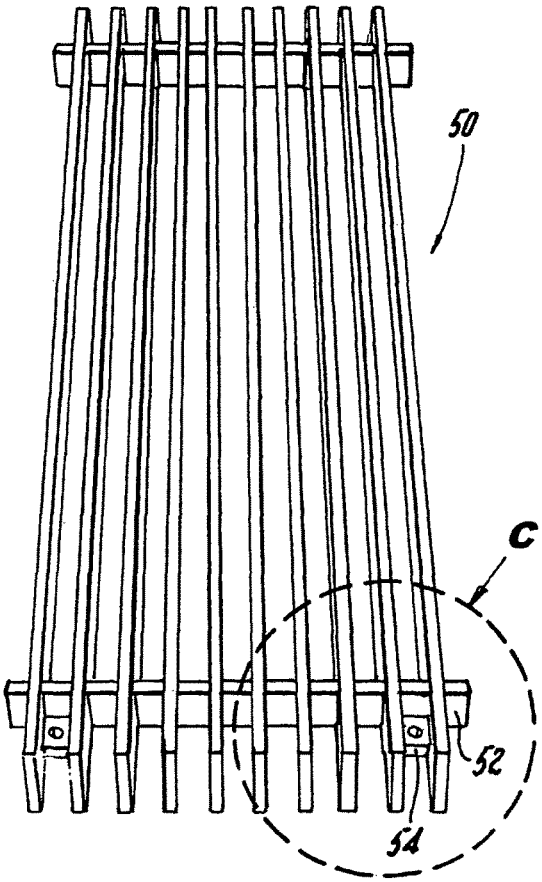
FIG. 11 is top view of the integrated cross bar having mounting tabs for the linear bar grille.

FIG. 11 shows a top view of the linear bar grille 50 having the integrated cross bar 52 with mounting tab 54.

Figure 12:
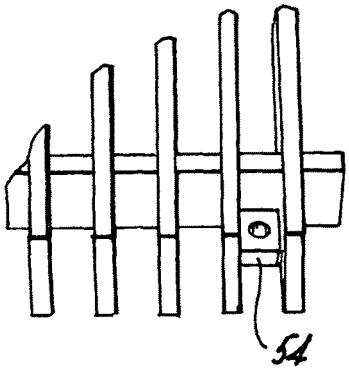
FIG. 12 is detailed view of section C of FIG. 11.

FIG. 12 is a sectional view of section C of FIG. 11 showing mounting 54.

Figure 13:
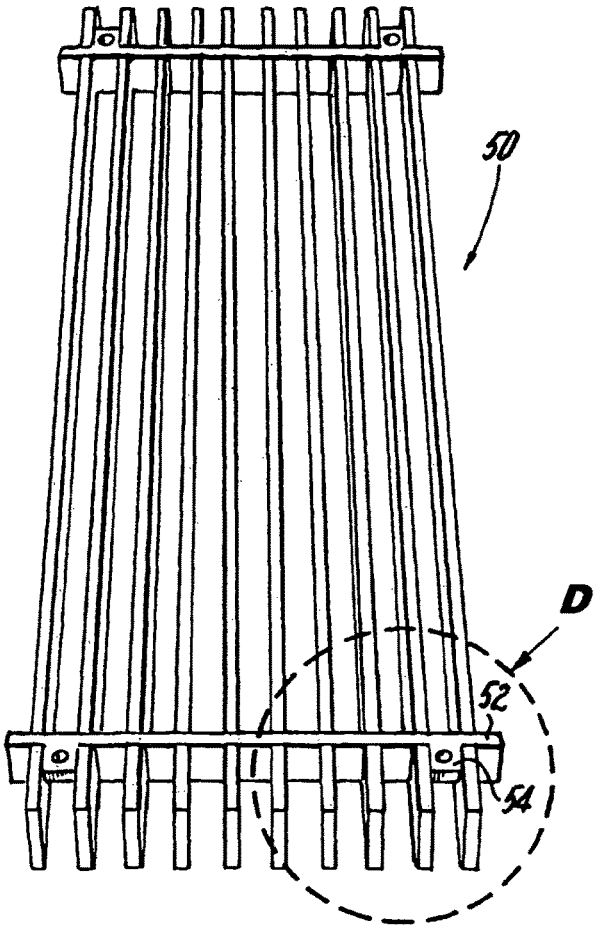
FIG. 13 is a bottom view of the integrated cross bar having mounting tabs for the linear bar grille.

FIG. 13 shows a bottom view of the linear bar grille 50 having the integrated cross bar 52 with mounting tab 54.

Figure 14:
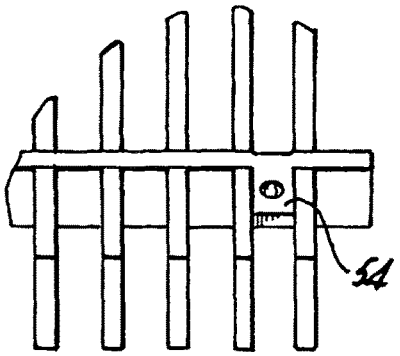
FIG. 14 is detailed view of section D of FIG. 13.

FIG. 14 is a sectional view of section D of FIG. 13 showing the mounting tab 54.

Figure 15:
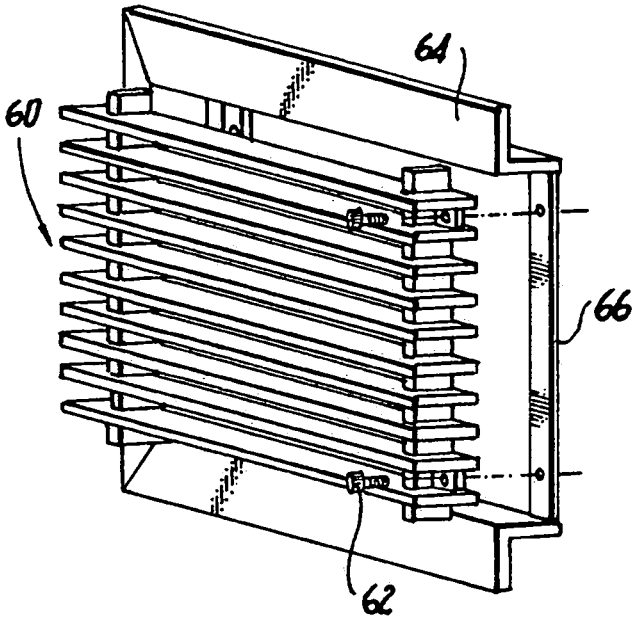
FIG. 15 shows an unassembled view of a removable core and grille frame.

FIG. 15 shows an unassembled view of a removable core 60 (linear bar section) which is fastened by cap screws 62 to a grille frame 64, the fasteners 62 are fastened to a mounting strip 66.

Figure 16:
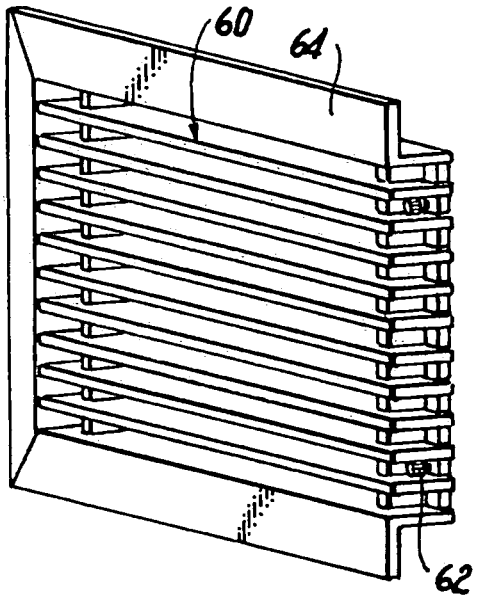
FIG. 16 shows an assembled view of a removable core and grille frame.

FIG. 16 shows the assembled view of FIG. 15.

The invention claimed is:

1. A linear bar grille and a device for mounting said linear bar grille comprising: linear bars and cross bars;

said linear bars having no indentations or protrusions;

each of said linear bars are attached to at least two of said cross bars;

one or more single piece cross bar mounting tabs that is integral with and protrudes directly from said cross bar;

said one or more mounting tabs comprising a through hole;

said through hole accommodating a mechanical fastener;

each of said one or more mounting tabs located within a space between two consecutive of said linear bars of said linear bar grille;

said mounting tabs contacting each of said linear bars;

said mounting tabs bent towards and at a right angle from said cross bar;

said linear bars having a top edge and a bottom edge, the bottom edge being adjacent to the mounting tabs, wherein the bottom edge of the linear bars are substantially flush with a main surface of the mounting tabs.

2. The linear bar grille and device of claim 1 wherein said cross bar comprises a minimum of one mounting tab used to mount said linear bar grille.

3. The linear bar grille and device of claim 1 wherein said mounting tabs are located on multiple positions on said cross bar.

4. The linear bar grille and device of claim 1 wherein said mounting tab is a pre-punched, cut or perforated, pre-cut tab.

5. The linear bar grille and device of claim 1 wherein as many integrated cross bars with mounting tabs are used as required.

6. The linear bar grille and device of claim 1 further comprising a grille frame.

7. The linear bar grille and device of claim 6 wherein said fastener is attached to said frame of said linear bar grille making a core portion removable and re-attachable.

8. A linear bar grille and a device for mounting said linear bar grille comprising:

linear bars and cross bars; said linear bars having no indentations or protrusions; each of said linear bars attached to at least two of said cross bars;

one or more single piece cross bar mounting tabs;

said one or more mounting tabs comprising a through hole;

said through hole accommodating a mechanical fastener;

each of said one or more mounting tabs located within a space between and contacting two consecutive of said linear bars;

said mounting tab bent towards and at a right angle from said cross bar:

said mounting tab protruding directly from said cross bar;

said linear bars having a top edge and a bottom edge, the bottom edge being adjacent to the mounting tabs, wherein the bottom edge of the linear bars are substantially flush with a main surface of the mounting tabs.

* * * * *